US006455486B1

(12) United States Patent
Kerobo et al.

(10) Patent No.: US 6,455,486 B1
(45) Date of Patent: Sep. 24, 2002

(54) ANTI-SPOTTING AND ANTI-FILMING HARD SURFACE CLEANING FORMULATIONS AND METHODS

(75) Inventors: Charles O. Kerobo, Southfield; Michael C. Welch, Woodhaven, both of MI (US); Richard J. Holland, Flanders, NJ (US); Sonia J. Patterson, Detroit; Suzanne M. Gessner, Ypsilanti, both of MI (US)

(73) Assignee: BASF Corporation, Mount Olive, NJ (US)

( * ) Notice: Subject to any disclaimer, the term of this patent is extended or adjusted under 35 U.S.C. 154(b) by 0 days.

(21) Appl. No.: 09/699,442

(22) Filed: Oct. 31, 2000

Related U.S. Application Data

(62) Division of application No. 09/559,257, filed on Apr. 27, 2000.

(51) Int. Cl.[7] ..... C11D 1/68; C11D 3/20; C11D 3/37; C11D 3/43

(52) U.S. Cl. ..... 510/421; 510/238; 510/239; 510/240; 510/245; 510/364; 510/365; 510/434; 510/476; 510/477; 510/488; 510/500; 510/506; 510/533

(58) Field of Search ..... 510/238–240, 510/245, 364, 365, 421, 434, 476, 477, 488, 500, 506, 533

(56) References Cited

U.S. PATENT DOCUMENTS 4,846,994 A 7/1989 Kud et al. ..... 252/174.21
5,733,856 A * 3/1998 Gopalkrishnan et al. .... 510/360
5,750,483 A * 5/1998 Welch et al. ..... 510/230
6,172,028 B1 * 1/2001 Baur et al. ..... 510/361
6,315,835 B1 * 11/2001 Kerobo et al. ..... 134/3

FOREIGN PATENT DOCUMENTS

EP 358473 A2 * 3/1990

* cited by examiner

*Primary Examiner*—Yogendra N. Gupta
*Assistant Examiner*—Brian P. Mruk
(74) *Attorney, Agent, or Firm*—Nixon & Vanderhye P.C.

(57) ABSTRACT

Cleaning formulations and methods are provided by which solid deposition is inhibited on hydrophobic hard surfaces typically encountered in bathroom and outdoor environments without detrimentally affecting the appearance of such surfaces. The formulations most preferably include an aqueous mixture of an organically solvated nonionic copolymer, a polyacrylic acid homopolymer and a nonionic surfactant. Optionally, a hydrotrope may also be present in the formulation. Most preferably, the formulations of this invention have a pH between about 4.0 to about 7.0, most preferably around neutral (i.e., about 7.0). In specific embodiments, the formulations include an aqueous mixture of (a) a graft copolymer of polyalkylene oxide with vinyl ester, the graft copolymer having a molecular weight within the range of about 5,000 to 50,000, (b) at least one polycarboxylate selected from the group consisting of acrylic acid/maleic acid copolymers, having a molecular weight within the range of about 1,000 to 100,000 and polyacrylic acid having a molecular weight of from about 1,000 to about 100,000, (c) at least one nonionic surfactant selected from the group consisting of alcohol alkoxylates, alcohol block alkoxylates, and polyoxyethylene/polyoxypropylene triblock surfactants, and (d) one or more water soluble organic solvents.

11 Claims, No Drawings

ANTI-SPOTTING AND ANTI-FILMING HARD SURFACE CLEANING FORMULATIONS AND METHODS

This is a divisional of application Ser. No. 09/559,257, filed Apr. 27, 2000, now pending, the entire content of which is hereby incorporated by reference in this application.

FIELD OF THE INVENTION

The present invention relates generally to hard surface cleaners. In particular, the present invention relates to hard surface cleaners that are effective to clean soils normally found in bathroom and outdoors environments.

BACKGROUND AND SUMMARY OF THE INVENTION

Hard surface cleaners that perform to clean soils commonly found in bathroom and outdoors environments are known. For example, U.S. Pat. Nos. 5,252,245; 5,437,807 and 5,468,423 disclose reduced residue hard surface cleaner compositions based on solvents, blends of amphoteric, nonionic and anionic surfactants and nitrogenous buffering agents.

U.S. Pat. No. 5,454,984 discloses a cleaning composition comprised of quaternary ammonium compounds, tetrasodium EDTA, a mixture of surfactants and a glycol ether. U.S. Pat. No. 5,585,342 discloses reduced residue hard surface cleaner compositions based on a solvent with a vapor pressure of at least 0.001 mm Hg at 25° C., at least one semi-polar nonionic surfactant and a nitrogenous buffering agent. U.S. Pat. Nos. 5,536,452 and 5,587,022 disclose an aqueous rinsing solution for shower surfaces consisting essentially of a nonionic surfactant having an HLB of 13 or less, a chelating agent and, optionally, an alcohol and/or ammonium hydroxide and/or morpholine. U.S. Pat. No. 5,814,591 discloses an aqueous hard surface cleaner based on either a nonionic surfactant with, optionally, a quaternary ammonium surfactant present in a cleaning effective amount, an organic solvent with a vapor pressure of at least 0.001 mm Hg and ammonium ethylenediamine tetraacetate.[1]

[1] The entire content of each cited patent is expressly incorporated hereinto by reference.

While at least some of the conventional formulations described in the prior-issued U.S. patents cited above are effective at removing soils and inhibiting the adsorption and coalescence of soils, calcium soaps and/or calcium carbonate on ceramic tile surfaces found in a bathroom environment, they do not demonstrate a high level of efficacy on other non-tile hard surfaces (e.g., glass, metal, vinyl and fiberglass surfaces) commonly found in bathroom and outdoor environments. In fact, some of these conventional cleaning formulations actually dull the finish of glass, metal and/or vinyl surfaces thereby reducing their effectiveness from a consumer's point of view.

It would therefore be highly desirable if cleaning formulations could be provided which are effective at cleaning universally a variety of hard surfaces commonly found in bathroom and outdoors environments. It is towards providing such a needed formulation that the present invention is directed.

Broadly, the present invention is embodied in cleaning formulations and methods by which solid deposition is inhibited on hydrophobic hard surfaces typically encountered in bathroom and outdoor environments without detrimentally affecting the appearance of such surfaces. In this regard, the formulations of the present invention have been found to exhibit reduced spotting and filming.

The formulations of the present invention most preferably include an aqueous mixture of a nonionic copolymer, a polyacrylic acid homopolymer, and a nonionic surfactant. Optionally, a hydrotrope may also be present in the formulation. Preferably, the formulations of this invention have a pH between about 4.0 to about 7.0, more preferably around neutral (i.e., about 7.0). In specific embodiments, the formulations of the present invention include an aqueous mixture of (a) a graft copolymer of polyalkylene oxide with vinyl ester, the graft copolymer having a molecular weight within the range of about 5,000 to 50,000, (b) at least one polycarboxylate selected from the group consisting of acrylic acid/maleic acid copolymers, having a molecular weight within the range of about 1,000 to 100,000 and polyacrylic acid having a molecular weight of from about 1,000 to about 100,000, (c) at least one nonionic surfactant selected from the group consisting of alcohol alkoxylates, alcohol block alkoxylates, and polyoxyethylene/polyoxypropylene triblock surfactants, and (d) one or more water soluble organic solvents.

These and other aspects and advantages will become more apparent after careful consideration is given to the following detailed description of the preferred exemplary embodiments thereof.

DETAILED DESCRIPTION OF THE INVENTION

As noted previously, the formulations of the present invention are usefully employed to clean universally a variety of hard surfaces commonly found in bathroom and outdoors environments. Exemplary hard surfaces that can be advantageously cleaned by the formulations of the present invention without dulling or otherwise significantly adversely affecting the surface finish include ceramic tile, glass, metal, vinyl and fiberglass surfaces.

The formulations of the present invention will necessarily include a polymer blend comprised of a graft copolymer and at least one polycarboxylate. The graft copolymer employed in the formulations of the present invention will have a molecular weight (all MW's herein are expressed in terms of weight average molecular weight, unless otherwise specified) of about 5,000 to 50,000. More preferably, the graft copolymer will have a molecular weight within the range of about 10,000 to 35,000, more preferably within the range of about 15,000 to 30,000. In one especially desirable embodiment of the invention, the graft copolymer of polyalkylene oxide (preferably polyethylene oxide) with vinyl acetate will have a molecular weight of about 24,000. This graft copolymer is commercially available from BASF Corporation under the trademark SOKALANO HP 22.

The graft copolymer as one component of cleaning formulations of the present invention may be synthesized in accordance with the procedures set forth in Holland et al., U.S. Pat. No. 4,999,869, incorporated herein by reference. The polyalkylene oxide component of the graft copolymer may be selected from the group consisting of polyethylene oxide, polypropylene oxide and polybutylene oxide, including mixtures thereof. In a preferred embodiment herein, vinyl acetate is grafted onto polyethylene oxide.

The polycarboxylate component of the polymer blend employed in the formulations of the present invention is selected from the group consisting of acrylic/maleic acid copolymers having a molecular weight within the range of about 1,000 to 100,000, and polyacrylic acid having a molecular weight of from about 1,000 to 100,000. The preferred acrylic/maleic acid copolymers are selected from the group of compounds with the following formula:

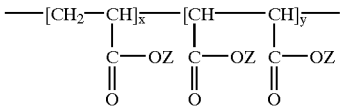

wherein z is hydrogen or an alkali metal, preferably sodium, and x and y are numbers such that the molecular weight of the acrylic/maleic acid copolymer is within the range of about 1,000 to 100,000, more preferably from about 2,000 to about 85,000, and even more desirably within the 10 range of about 2,500 to about 75,000. In one especially preferred embodiment of the invention, the acrylic/maleic acid copolymer will have a molecular weight within the range of about 1,000 to 100,000, more desirably from about 1,000 to 20,000, and even more preferably from about 1,000 to 10,000. In a more preferred embodiment, the polyacrylic acid has a molecular weight of about 8,000. This component may be obtained from BASF under the trademark SOKALAN® PA30Cl.

The nonionic surfactant employed in the formulations of the present invention is preferably at least one selected from the group consisting of alcohol alkoxylates, alcohol block alkoxylates, polyoxyethylene polyoxypropylene block surfactants, and mixtures thereof. Surfactants with a wide range of hydrophile-lipophile balance (HLB) can be used in the invention. As is well known in the art, the alcohol alkoxylates are made by using an alcohol as an initiator molecule, and polymerizing an alkylene oxide or a mixture of alkylene oxides onto the initiator molecule to form a first block. Thereafter, a second alkylene oxide or mixture of alkylene oxides can optionally be added to form a second block. Third and subsequent blocks can also be added. Generally, the only proviso is that adjacent blocks have different relative alkylene oxide compositions.

Alcohol alkoxylates are commercially available, for example, from BASF Corporation under the registered trademark PLURAFAC®. Exemplary are surfactants represented by the general formula $$R\text{-}(\text{oxide } 1)_a\text{-}OR'$$

where R is the alkyl residue of an alcohol which has 6 to 24 carbon atoms; a represents the average number of alkylene oxide units in the structure; oxide 1 is an alkylene oxide selected from the group consisting of ethylene oxide, propylene oxide, butylene oxide, and mixtures thereof; and where R' is hydrogen, an alkyl group with 1 to 18 carbon atoms, a hydroxyalkyl group, or a mixture thereof. As used herein, butylene oxide refers to any of 1,2-butylene oxide, 2,3-butylene oxide, and isobutylene oxide, and to each of them. These surfactants are made by adding the alkylene oxide or mixture of alkylene oxides to an alcohol R-OH. The parameter a can take on a wide range of values. For example, it has been found that useful surfactants are obtained when a is less than or equal to about 30. It is more preferable that a be less than about 20. The oxide 1 is preferably a heteric blend of ethylene oxide and propylene oxide, with ethylene oxide being present at greater than 50%, preferably at greater than 70% of the total number of the alkylene oxide units in the structure. The R group preferably has from about 8 carbons to about 16 carbons, and more preferably from about 10 to about 16 carbons. A preferred surfactant is one where R contains 10 to 12 carbon atoms, R' is hydrogen and a is about 15, where of the 15 units of alkylene oxide, about 13 are ethylene oxide and about 2 are propylene oxide.

Also useful are the diblock and the triblock alcohol alkoxylates. The diblock alcohol alkoxylates can be represented as $$R\text{-}(\text{oxide } 1)_a\text{-}(\text{oxide } 2)_b\text{-}OR'$$

while the triblock alcohol alkoxylates can be represented as $$R\text{-}(\text{oxide } 1)_a\text{-}(\text{oxide } 2)_b\text{-}(\text{oxide } 3)_c\text{-}OR'$$

where R is an alkyl or aralkyl group containing 6 to 24 carbon atoms; oxide 1, oxide 2, and oxide 3 each represent an alkylene oxide selected 5 from the group consisting of ethylene oxide, propylene oxide, butylene oxide, and mixtures thereof, with the proviso that the relative alkylene oxide composition of oxide 2 differ from that of oxide 1 and oxide 3; a, b, and c are each from about 1 to 35; and R' is hydrogen, an alkyl group with 1 to 18 carbon atoms, a hydroxyalkyl group with 1 to 18 carbon atoms, or a mixture thereof.

Examples of useful alcohol block alkoxylates are the diblock alkoxylates where the blocks are essentially all ethylene oxide or essentially all propylene oxide. These can be represented by the general formulas $$R\text{-}(eo)_a\text{-}(po)_b\text{-}OR'$$

or $$R\text{-}(po)_a\text{-}(eo)_b\text{-}OR'$$

where R is the alkyl or arylalkyl residue of an alcohol containing 6 to 24 carbon atoms; a and b are each from 1 to about 30; eo represents an ethylene oxide unit; po represents a propylene oxide unit; and R' is hydrogen, an alkyl group with 1 to 18 carbon atoms, a hydroxyalkyl group with 1 to 18 carbon atoms, or a mixture thereof.

One class of polyoxyethylene polyoxypropylene block surfactants useful in the invention is the triblock surfactants represented by the general formula $$R\text{-}(eo)_a\text{-}(po)_b\text{-}(eo)_c\text{-}R'$$

where a, b, and c each represent the number of ethylene oxide or propylene oxide units in each of the blocks, and where R and R' are independently H, $C_{1-18}$ alkyl, $C_{1-18}$ hydroxyalkyl, or a mixture thereof. Members of this class of surfactants are commercially available as the Pluronic® surfactants of BASF Corporation.

When such a triblock surfactant is subjected to further reaction with propylene oxide so that polyoxypropylene groups are added to the ends of the triblock surfactant, there is obtained another useful polyoxyethylene polyoxypropylene block surfactant, which can be represented in a similar fashion as $$R\text{-}(po)_a\text{-}(eo)_b\text{-}(po)_c\text{-}(eo)_d\text{-}(po)_e\text{-}R'$$

where a, b, c, d, and e each represent the number of ethylene oxide or propylene oxide units in each of the blocks, and where R and R' are independently $H_1$, $C_{1-18}$ alkyl, $C_{1-18}$ hydroxyalkyl, or a mixture thereof.

Preferred polyoxyethylene polyoxypropylene block surfactants have a number average molecular weight of from about 1800 to about 6000, more preferably from about 2000 to about 4000. The block surfactants are preferably comprised of about 20% to about 60% by weight of polyoxyethylene blocks, and more preferably from about 25% to about 50%. A preferred block surfactant is a five block polyoxyethylene polyoxypropylene surfactant having a molecular weight of about 3200, and wherein the polyoxyethylene blocks comprise about 34% of the total weight.

One particularly preferred diblock alcohol surfactant is PLURFAC® D25 surfactant commercially available from BASF Corporation. This preferred surfactant has an HLB of about 10, and a cloud point (1% aqueous solution) of 59° C.

The organic solvent useful in the formulations of the present invention enhances the cleaning performance by causing the compositions to rinse better or to drain more readily from vertical surfaces. The solvent can also increase the evaporation rate of the cleaning composition, which reduces streaking and leads to a glossier looking surface. Thus the organic solvent is to be chosen based on its solubility in water, and its having sufficient volatility to perform well in cleaning. Further, it is naturally desirable that the solvent be non-toxic and have a non-offensive odor. Useful solvents are described in U.S. Pat. No. 5,814,591 and U.S. Pat. No. 5,585,342, the entire content of each being expressly incorporated hereinto by reference.

Within the above parameters, a wide range of solvents is useful. Typical, but non-limiting examples are alcohols with one to six carbons, alkylene glycols, alkyl ethers of alkylene glycols, alkanolamines, N-alkyl alkanolamines, low molecular weight ketones, and water soluble alkyl pyrrolidones. Examples of the above classes include ethanol, propanol, isopropanol, butanol and its isomers, ethylene glycol and its alkyl ethers such as ethylene glycol methyl ether and ethylene glycol monobutyl ether, alkyl ethers of propylene glycol such as propylene glycol monopropyl ether, propylene glycol monobutyl ether, and propylene glycol mono-t-butyl ether, acetone, butanone, and N-methylpyrrolidone.

Examples of less desirable solvents are methanol because of its toxicity, and water-soluble carboxylic acids such as acetic acid and butyric acid as well as water-soluble organic amines because of their objectionable odor. Some solvents may be so volatile that their use is less preferred. An example in the latter category is acetone.

Solvents preferred for their blend of desirable properties such as commercial availability, low toxicity, no objectionable odor, and good performance in cleaning include isopropyl alcohol, the monobutyl ether of ethylene glycol and N-methylpyrrolidone (NMP). NMP is especially preferred.

The formulations of the present invention may also contain other components and agents as may be desired. For example, a hydrotrope (e.g., sodium xylene sulfonate) may be present in the formulations. In addition, it may be necessary to include a pH control agent, such as citric acid, so that the formulations of this invention can be adjusted if needed to be within the desired pH range. Other additives, such as, for example, preservatives, thickeners, antibacterial agents, buffers, perfumes, dyes and the like may be included to achieve the desired properties.

The nonionic copolymer and polyacrylic acid homopolymer will each most preferably be present in the formulations of the present invention in an amount between about 0.005 wt. % to about 1.0 wt. %, more preferably about 0.01 to about 0.10 wt. %, and most preferably between about 0.03 to about 0.10 wt. %. The nonionic surfactant will generally be present in an amount between about 0.05 wt. % to about 3.0 wt. %, and more preferably about 0.05 to about 1.0 wt. %, and most preferably from about 0.1 to about 0.5 wt. %. The organic solvent component (e.g., isopropyl alcohol, ethylene glycol monobutyl ether and/or NMP) is generally present in an amount of between about 0.005 wt. % to about 5.0 wt. %, more preferably from about 0.005 to about 0.5 wt. %, and most preferably from about 0.03 to about 0.10 wt. %. If present, the hydrotrope (e.g., sodium xylene sulfonate) will be employed in an amount between about 0.005 wt. % to about 2.0 wt. %. The balance of the liquid formulations will be water.

The weight percentages noted above are for a so-called "no rinse" use (i.e., for a diluted aqueous liquid formulation applied directly onto the hard surface). Such weight percentages should be multiplied by an appropriate dilution factor in order to obtain concentrations of the individual components in a concentrated solution. Depending on the particular sprayer that may be employed to mix the concentrated formulation with water when applying it to the hard surface, the dilution factor could be between about 1 to about 100 or more.

The present invention will be illustrated further by the following non-limiting examples.

EXAMPLES

Test Formulation

In the tests described below, a "no rinse" formulation in accordance with the present invention was used:

| Amount (wt. %) | Component |
|---|---|
| 0.06 | nonionic graft copolymer (SOKALAN ® HP22) |
| 0.06 | polycarboxylate (SOKALAN ® PA30CL) |
| 0.24 | nonionic surfactant (PLURAFAC ® D25) |
| 0.06 | N-methylpyrrolidone |
| 0.03 | sodium xylene sulfonate |
| 0.06 (+/−) | citric acid |
| balance | water |

Note:
Citric acid was used, if necessary, to adjust pH of the test formulations to about neutral (i.e., about 7.0)

Test Methods and Procedures:

A parent soil recipe was initially made with the following ingredients

| | |
|---|---|
| Ivory ® bar soap (a) | 3.90% by weight |
| Shampoo (b) | 0.35 |
| Clay soil (c) | 0.06 |
| Artificial sebum (d) | 0.15 |
| Hard water (e) | 95.54 |

Notes:
(a) Ivory ® is a registered trademark of Procter & Gamble Co.
(b) A simple, moderate-cleaning commercial shampoo containing alkyl ethoxysulfates, such as Baby Shampoo commercially available from Johnson & Johnson Inc. was used. Shampoos containing conditioning or treatment additives should be avoided.
(c) Ball or bandy black clay commercially available from H. C. Spinks Co., Paris TN was used.
(d) Spangler, et al., "A Laboratory Method for Testing Laundry Products for Detergency," JAOCS, Vol. 42, August 1965, pp. 723–727, the entire content of which is incorporated expressly by reference herein.
(e) 20,000 ppm, 2:1 calcium:magnesium, as $CaCO_3$, using calcium chloride dihydrate and magnesium chloride hexahydrate.

Procedure: The bar soap was shaved and placed in suitable beaker. The remainder of the components was added, in order, and stirred with a three-blade propeller mixer. The entire mixture was warmed to 45–50° C. and was mixed until a smooth suspension is achieved. The suspension was filtered through a Buchner funnel fitted with Whatman # 1 filter paper. The entire filtrate soil was resuspended in deionized water using the same volume of water that was used to make the soil and the filtrate cake was dried overnight in a 45° C. oven. The dry cake was then pulverized and kept in a closed container away from ambient moisture.

Next, a reconstituted soil was made from the parent soil by combining the following components and homogenizing the suspension until its color turned from white to gray:

| | |
|---|---|
| Parent soil | 4.50% by weight |
| Hard water (as above) | 9.00 |
| HCl (37%) | 0.77 |
| Acetone | 85.73 |

A. Soak test

The soak test was used as an initial screening evaluation for the formulations. If a test solution passed the soak test, then it was further evaluated in the glass and vinyl tests described below. In this regard, ceramic tiles were first prepared by washing, drying, and cooling at room temperature; airbrushing 0.1–0.15 g of reconstituted soil onto the tiles; baking at approximately 320° C. for 2 minutes; and then cooling overnight at room temperature.

To perform the soak test, the tiles prepared as in the preceding paragraph were soaked in the test formula noted above for 5 minutes, and the efficacy of the cleaning was determined qualitatively. It was determined qualitatively that the formulation of the present invention passed the soak test.

B. Glass and vinyl spotting and filming test.

To conduct this test, the test solution was sprayed by hand with a trigger spray bottle onto a test piece which was either a 4"×4" ceramic tile or a 3"×8" piece of glass or vinyl. The test piece was allowed to dry for 24 hours, and was evaluated qualitatively according to the scale below. The rating was reported using the following qualitative test scale where the higher the numeric value of the qualitative test rating, the more desirable was the result:

| Rating | Qualitative Appearance |
|---|---|
| 1 | very streaky; tracks from build-up |
| 2 | some streaks; light build-up |
| 3 | even distribution of a thick film |
| 4 | even distribution of a light film |
| 5 | even distribution with semi-gloss |

The ceramic test piece was evaluated as a "5" rating, while the glass and vinyl test pieces were evaluated as a "2" and "4" rating, respectively.

C. Outside Window Cleaning Test

A concentrated test solution was placed in a hose end sprayer and was sprayed onto an outside window. The dilution of the sprayer was adjusted so as to deliver a "no rinse" test solution with the concentrations noted above onto the window. Good sheeting action was observed on the window, and the window showed minimal spotting and filming after it dried (about 30 minutes).

D. Lab Cleaning Test

The test solution noted above was sprayed onto a 3"×8" piece of glass. A control was also run which did not contain the SOKALAN® polymeric materials.

The test glass and the control were compared under a polarized light microscope. The control showed a high degree of spotting and filming, whereas the test glass with the formulation of the present invention (i.e., containing the SOKALAN® polymeric materials) was essentially free of spotting and filming.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A no-rinse aqueous hard surface cleaning formulation capable of being applied to a hard surface and cleaning said hard surface without rinsing, said formulation comprising a hard surface cleaning effective amount of:

(a) between about 0.01 to about 0.10 wt. % of a graft copolymer of polyalkylene oxide with vinyl ester, the graft copolymer having a molecular weight within the range of about 5,000 to 50,000;

(b) between about 0.01 to about 0.10 wt. % of at least one polycarboxylate selected from the group consisting of acrylic acid/maleic acid copolymers, having a molecular weight within the range of about 1,000 to 100,000 and polyacrylic acid having a molecular weight of from about 1,000 to about 100,000;

(c) between about 0.1 to about 0.5 wt. % of at least one nonionic surfactant selected from the group consisting of alcohol alkoxylates, alcohol block alkoxylates, and polyoxyethylene/polyoxypropylene triblock surfactants; and (d) between about 0.005 to about 0.5 wt. % of one or more water-soluble organic solvents.

2. A formulation according to claim 1, wherein the graft copolymer comprises a graft polymer of vinyl acetate with polyethylene oxide.

3. A formulation according to claim 2, wherein the polycarboxylate comprises polyacrylic acid.

4. A formulation according to claim 1, wherein said polycarboxylate comprises polyacrylic acid.

5. A formulation according to claim 1, wherein the one or more organic solvents comprises N-methyl pyrrolidone.

6. A formulation according to claim 1, wherein the one or more organic solvents comprises ethylene glycol monobutyl ether.

7. An aqueous hard surface cleaning formulation comprising a hard surface cleaning effective amount of:

(a) a graft copolymer of polyalkylene oxide with vinyl ester, the graft copolymer having a molecular weight within the range of about 5,000 to 50,000;

(b) at least one polycarboxylate selected from the group consisting of acrylic acid/maleic acid copolymers, having a molecular weight within the range of about 1,000 to 100,000 and polyacrylic acid having a molecular weight of from about 1,000 to about 100,000;

(c) at least one nonionic surfactant selected from the group consisting of alcohol alkoxylates, alcohol block alkoxylates, and polyoxyethylene/polyoxypropylene triblock surfactants; and (d) one or more water soluble organic solvents selected from the group consisting of N-methyl pyrrolidone and ethylene glycol monobutyl ether.

8. The formulation of claim 7, wherein component (a) is present in an amount between about 0.01 to about 0.10 wt. %.

9. The formulation of claim 7 or 8, wherein component (b) is present in an amount between about 0.01 to about 0.10 wt. %.

10. The formulation of claim 9, wherein component (c) is present in an amount between about 0.1 to about 0.5 wt. %.

11. The formulation of claim 10, wherein component (b) is present in an amount between about 0.005 to about 0.5 wt. %.

* * * * *